US005914435A

United States Patent [19]

Streicher et al.

[11] Patent Number: 5,914,435

[45] Date of Patent: Jun. 22, 1999

[54] PROCESS FOR REDUCING THE BENZENE CONTENT IN A HYDROCARBON FRACTION

[75] Inventors: Christian Streicher; Isabelle Prevost, both of Rueil Malmaison, France

[73] Assignee: Institut Francais Du Petrole, France

[21] Appl. No.: 08/936,100

[22] Filed: Sep. 23, 1997

[30] Foreign Application Priority Data

Sep. 24, 1996 [FR] France ..... 96 11696

[51] Int. Cl.[6] ..... C07C 29/80; C07C 7/144

[52] U.S. Cl. ..... 585/819; 585/818; 203/DIG. 19

[58] Field of Search ..... 585/819, 818; 203/DIG. 19

[56] References Cited

U.S. PATENT DOCUMENTS

| | | | |
|---|---|---|---|
| 2,985,588 | 5/1961 | Binning et al. | 210/23 |
| 4,211,886 | 7/1980 | Tabak et al. | 585/321 |
| 4,299,667 | 11/1981 | Klein et al. | 203/42 |
| 4,774,365 | 9/1988 | Chen et al. | 568/697 |
| 4,944,880 | 7/1990 | Ho et al. | 210/640 |
| 4,990,276 | 2/1991 | Ho et al. | 252/62.3 Q |
| 4,997,906 | 3/1991 | Thaler et al. | 528/272 |
| 5,019,666 | 5/1991 | Sartori et al. | 585/819 |
| 5,288,712 | 2/1994 | Chen | 210/640 |
| 5,607,557 | 3/1997 | Streicher | 203/39 |

FOREIGN PATENT DOCUMENTS

| | | |
|---|---|---|
| 952102 | 3/1964 | United Kingdom . |
| 2 268 186 | 1/1994 | United Kingdom . |

*Primary Examiner*—Walter D. Griffin
*Assistant Examiner*—Tam M. Nguyen
*Attorney, Agent, or Firm*—Miller, White, Zelano, & Branigan, P.C.

[57] ABSTRACT

To reduce the benzene content of a hydrocarbon mixture that contains benzene and other hydrocarbons, the mixture is fed to a distillation column so as to separate an overhead distillate, a bottom residue, and a sidestream having a benzene content richer than in the distillate and in the residue; the resultant sidestream is sent to at least one permeation zone to permeate the benzene selectively and retain a retentate having a reduced content of benzene; and at least part of the retentate is recycled to at least one level in the distillation column, preferably two levels, one at above and one below the feedpoint to the column. The permeate benzene stream is optionally subjected to extractive distillation in order to increase the purity of the resultant benzene.

19 Claims, 2 Drawing Sheets

PROCESS FOR REDUCING THE BENZENE CONTENT IN A HYDROCARBON FRACTION

BACKGROUND OF THE INVENTION

This invention relates to a process for reducing the benzene content of hydrocarbon fractions.

It is important to reduce the benzene content of petroleum products, in particular those of gasolines. Actually, benzene, although having a high octane number, is a toxic and volatile compound. Thus, the U.S. Environmental Protection Agency "EPA" has published a simple reformulated gasoline model that refiners have had to use since 1995 and that sets, among other things, the maximum amount of benzene in gasolines at 1% by liquid volume.

The benzene that is present in the gasolines comes from native benzene that is present in crude petroleum and benzene that is synthesized during various refining operations. In particular, the ratio of benzene that is provided by the catalytic reforming effluents is estimated at about 75% of the total benzene that is present in the gasolines.

To reduce the benzene content of gasolines, refiners adopt several strategies; they can:

- pre-fractionate the catalytic reforming batch to eliminate a large portion of the benzene and its precursors (paraffins and naphthenes) at the top of the pre-fractionating column and to obtain, at the bottom, a $C_{7+}$ fraction that is low in benzene and that feeds the reforming; in this case, however, the hydrogen yield of the reforming will also be reduced;
- modify the operating conditions of reforming by reducing the harshness of the treatment (this reduces the octane number of the gasolines, however); or else
- post-fractionate the reformate to obtain at the top of the post-fractionating column a light benzene-rich fraction and, at the bottom, a $C_{7+}$ fraction that feeds the fuel pool.

The benzene that is recovered at the top of the pre-fractionation or post-fractionation can be either extracted with a solvent and used as a petrochemical base, or converted by alkylation or by hydrogenation and/or hydroisomerization, then sent to the fuel pool.

These different treatments are disadvantaged, however, because of the low benzene content of the effluents that are obtained at the top of the pre-fractionating column or post-fractionating column.

One way of obtaining an effluent that is more concentrated in benzene is to carry out lateral drawing-off on the pre-fractionating column or post-fractionating column, advantageously at the level where benzene concentration exhibits a peak. The benzene contents of this drawing-off not exceeding 10 to 30% by weight, however, a relatively high drawing-off flow is necessary to be able to decrease the benzene at the top and the bottom of the column in a significant way.

SUMMARY OF THE INVENTION

This invention particularly has as its object the elimination of these drawbacks. Its goal is the production of gasoline with a high octane number and a low benzene content.

The process of this invention applies more particularly to mixtures or aromatic, naphthenic, and paraffinic hydrocarbons that have a number of carbon atoms from 5 to 10, such as naphthas, reforming effluents, or naphtha steam-cracking effluents. It uses a permeation technique, combined with a distillation operation, for example, pre-fractionation or post-fractionation, as mentioned above. The distillation in question can also consist of stabilization of reforming effluents.

It should be recalled that permeation is a separation technique that uses the difference in chemical potential that exists for each component on the two sides of a membrane. The flow that goes through the membrane is referred to as the "permeate," and the flow that does not go through the membrane is referred to as the "retentate."

There are different permeation techniques for separating homogeneous mixtures, such as reverse osmosis, vapor permeation, and pervaporation.

In the process of the invention, the permeation stage is fed by a flow that is removed laterally on a distillation column, which can be, for example, a pre- or post-fractionation column or a stabilization column, preferably in a zone of this column where the liquid and/or vapor flows have a maximum benzene concentration, or near this maximum; it produces a permeate that is benzene-enriched and a retentate that is low in this same component, and at least a fraction of the retentate is returned to said distillation column.

The benzene-rich permeate that is thus obtained can be enriched very economically. Its benzene content can reach 90% by mass depending on the benzene selectivity of the membrane that is used and depending on the benzene concentration of the batch that feeds the permeation stage.

The process of the invention comprises the following stages:

a) A distillation column is fed at least by a mixture of hydrocarbons that contains benzene and other hydrocarbons, for example, 5 to 10 carbon atoms, with said column making it possible to separate a distillate and a residue;

b) at at least one point, a flow that is richer in benzene than the batch is drawn off on said distillation column; and c) said flow is sent to at least one permeation device that comprises a membrane that is selective for benzene, in which are separated a retentate that is low in benzene, at least part of which is sent to said column at at least one point on the latter, and a benzene-enriched permeate.

By this process, the benzene contents of the distillate and the residue are reduced substantially.

BRIEF DESCRIPTION OF THE DRAWINGS

FIGS. 1 and 2 are schematic flowsheets wherein FIG. 1 depicts the sidestream, the permeation device and the recycle of retentate to the distillation column, and FIG. 2 illustrates the ancillary purification of the permeate by extractive distillation.

DETAILED DESCRIPTION OF THE DRAWINGS

Figure 1:
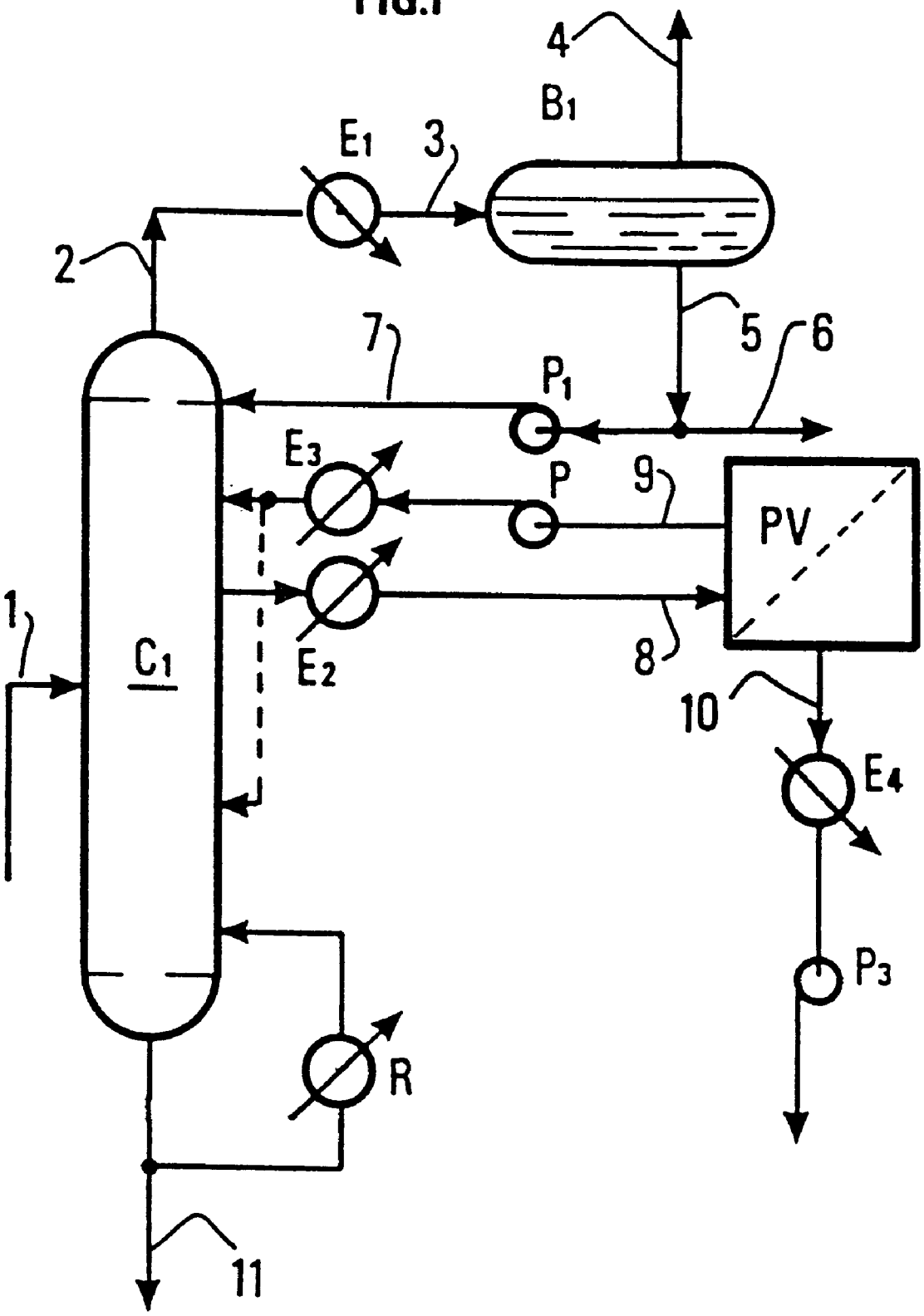

The process of the invention will be described in more detail below in connection with FIG. 1.

The mixture of hydrocarbons that is to be treated can contain, for example, 1 to 10% by mass of benzene.

In stage (a), the hydrocarbon batch to be treated enters via line 1 into distillation column C1, which is generally operated at a pressure of 1 to 5 bar and is heated by a reboiler R so that the bottom temperature is 150 to 200° C. The top temperature is generally set at about 50° C., with a reflux rate that is generally set at a value of 0.5 to 1 by mass relative to the column feed.

A vapor distillate that is cooled, for example, by passing into condenser E1, comes out at the top of column 1, via line 2, and is then sent into flask B1 via line 3. The condensed liquid phase is evacuated from flask B1 via line 5. A portion of the latter is refluxed to the top of column C1 via line 7 and pump P1. The other fraction, which is evacuated via line 6, constitutes the clean distillate. At the bottom, a residue is collected via line 11. In some cases, it is also possible to recover the clean distillate in vapor form, via line 4.

In stage (b), at from least one point of column C1, at least one liquid phase, vapor phase or mixed phase is drawn off laterally. The drawing-off is preferably done at a level of the column where the benzene concentration is approximately at a maximum.

The draw-off flow represents, for example, 30 to 70% by weight of the flow of liquid phase or vapor phase that feeds the drawing-off tray. The draw-off flow also represents 20 to 50% by weight of the batch that feeds the column. The drawn-off phase is generally brought to a temperature of 60 to 120° C. in exchanger E2 and at a pressure such that it is at least partially liquid at the temperature in question, before being sent to permeation stage (c) via line 8.

When the drawn-off phase in stage (b) is a liquid phase, the permeation technique used is more particularly a pervaporation. Furthermore, when the phase that is drawn off in stage (b) is a vapor phase or mixed phase, the permeation technique used is more particularly a vapor permeation.

In the permeation device of stage (c), a membrane is advantageously used that has, for example, a benzene selectivity relative to other hydrocarbons of at least 6 and can go up to 15 or more.

It is possible to use various membranes that are known in the art. Many examples of membranes that are suited for separation by permeation of aliphatic and aromatic hydrocarbon mixtures are described in the prior art. Thus, U.S. Pat. No. 4,944,880 cites the use of materials such as chlorinated polyurethanes, polyimides/polyadipates, polyimides/polysuccinates to produce membranes that have good properties of permeability and selectivity, in particular to separate toluene/n-octane or iso-octane mixtures. To carry out this same separation, U.S. Pat. Nos. 4,997,906 and 5,019,666 respectively describe membranes that are produced from crosslinked copolymers of polyester diols and dianhydrides and membranes that are produced from crosslinked polycarbonates.

Other permeation membranes are described in the prior art: for example, oxazolidone/polyurea membranes in U.S. Pat. No. 5,039,418 and various membranes of polyesters in U.S. Pat. Nos. 4,976, 868, 5,128,439 and 5,138,023.

Via line 9, the permeation stage produces a retentate that is low in benzene, which is picked up by pump P2 to be sent back partially or completely to laterally feed column C1 to at least one level of the latter. Thus, it can be advantageous to reintroduce the retentate at two levels, and more particularly at a level that is located above the feed of said column and at a level that is located below the latter. If necessary, the retentate can be reheated or cooled in exchanger E3, before being reintroduced into the column. It is also possible to separate this retentate into a liquid phase and a vapor phase, in a flash chamber, and to send back separately, partially or completely, one or two phases into said column.

Permeation stage (c) also produces, via line 10, a benzene-enriched vapor permeate, whose composition depends on the operating conditions of the process. The evacuated permeate of the permeation stage is condensed at low pressure in heat exchanger E4, and is then picked up by pump P3 to be sent to the subsequent treatment, such as, for example, extraction with solvent or extractive distillation, if it is desired to obtain the purified benzene that is intended for uses in petrochemistry.

The conditions of the permeation stage are generally adjusted such that the benzene content of the clean distillate which is recovered at the top of the column does not exceed, for example, about 3% by mass and such that in the permeate, about 50% of the benzene that is initially present in the feed of the permeation membrane is recovered. It is possible to adjust the amount of benzene that is thus recovered by causing the operating parameters of the process and particularly the drawing-off flow to vary. The concentration factor, which is defined as the ratio between the benzene concentration in the permeate to the benzene concentration in the main feed of the fractionating column, is generally between 10 and 20.

As already indicated above, the process of the invention, as described above, can be implemented in the processes for the production of reforming gasolines, at the level of pre-fractionation of a batch that consists of, for example, a naphtha, of post-fractionating effluents of a reforming unit, or of the stabilization of the effluents of a reforming unit.

In the first case, the batch to be treated is generally a naphtha, which can contain, for example, 1 to 2% benzene by weight. The distillation residue that is low in benzene and that contains mainly hydrocarbons of $C_{7+}$ can be used to feed the reforming unit. The distillate, which itself is also low in benzene, can be subjected to subsequent hydroisomerization treatment.

In the second case (post-fractionation), the reformate that is to be treated can contain, for example, about 5% benzene by weight. The residue is very low in benzene and can be sent to the fuel pool. The distillate, which contains the rest of the benzene that was not removed by permeation, can be subjected to subsequent treatment, for example, hydroisomerization.

In the two cases, if the benzene content of the distillate does not exceed 3% by weight, it can be isomerized without prior hydrogenation.

In the third case, that of stabilization of the reforming effluents, a residue that is low in benzene, which is generally sent to the fuel pool after other optional treatment, is recovered at the bottom of the stabilization column.

The advantages of the process of this invention over conventional techniques are many.

This process makes it possible in particular to reduce the overall operating costs associated with the enrichment of the benzene that is recovered during pre-fractionation or post-fractionation or stabilization by permeation. Even taking into account the additional costs of the permeation unit (limited to the energy for vaporizing and condensing the permeate), the overall operating costs are low owing to the increase in the benzene concentration in the effluent that is to be treated.

Because of the lower benzene content of the light fractions of pre-fractionation or post-fractionation, in the majority of the cases it is possible to avoid the stage of hydrogenation of light fractions (produced at the distillation head in post-fractionation or pre-fractionation) prior to hydroisomerization.

It is also possible to carry out fractionation with more flexibility and thus to extract a variable amount of benzene depending on market demand, specification constraints, and/or the variations of benzene content in the feed.

The process of the invention can also be easily implemented in existing installations and can operate independently.

Figure 2:
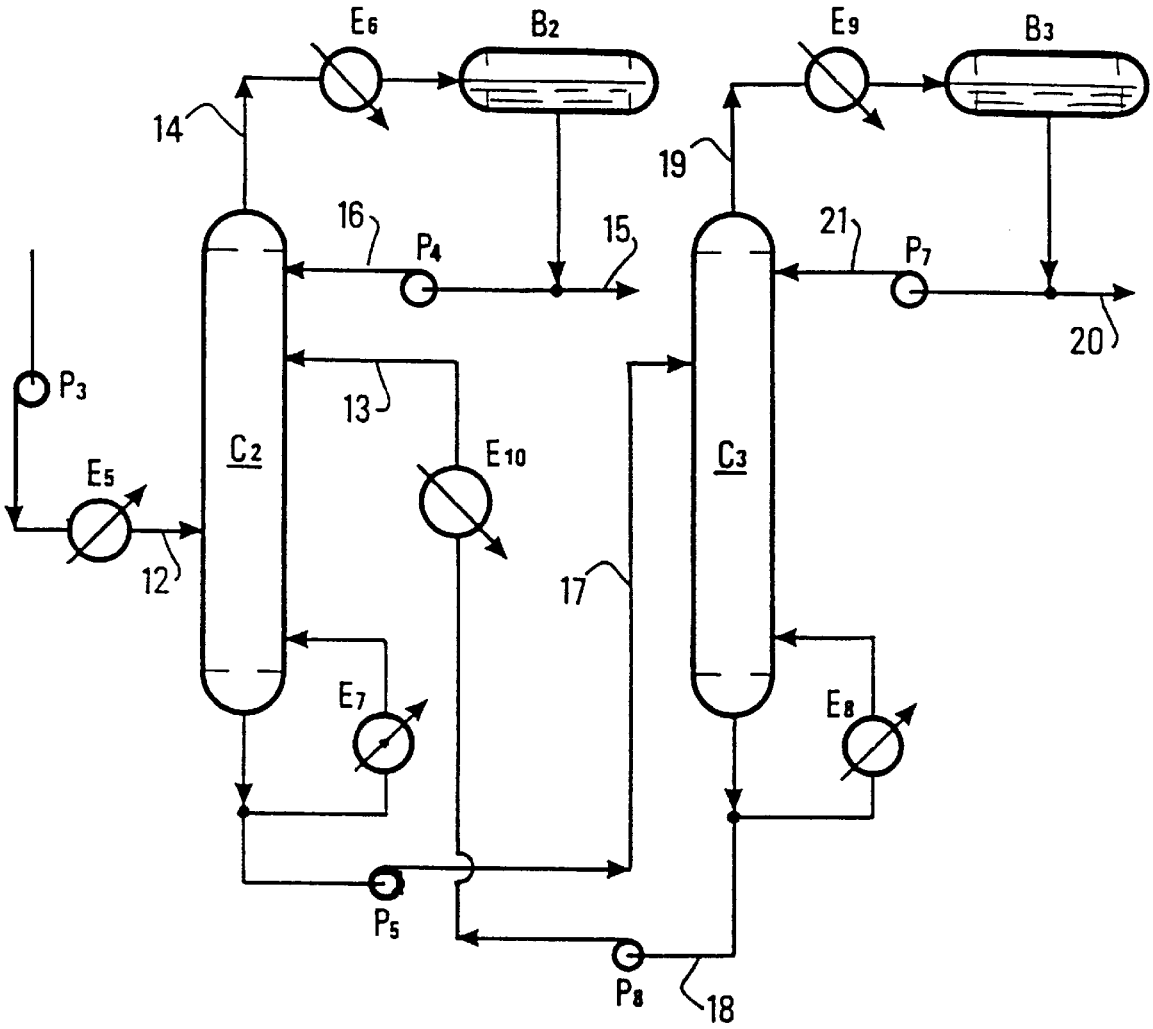

The process for reducing the benzene content of the effluents of pre-fractionation, post-fractionation or stabilization as was described above, implementing a permeation stage on a flow that is drawn off laterally on the column for pre-fractionation, post-fractionation or stabilization, produces a benzene-enriched permeate that can be treated subsequently to enrich it further, by known means, for example by extractive distillation, as will be described below in connection with FIG. 2.

In this case, following stages (a), (b) and (c), as they were described above, an extractive distillation stage that is fed by the permeate, which was extracted under reduced pressure in stage (c) and condensed at low temperature in heat exchanger E4, is added. It is picked up by pump P3 and vaporized in heat exchanger E5.

The permeate is introduced via pipe 12 into column C2, which operates at a pressure close to atmospheric pressure.

Upon contact with the liquid solvent that is introduced by pipe 13 at the top of the column, the vapors have reduced levels of benzene and their heavier components. They come out at the top via pipe 14 and, after they are fully condensed at about 70° C. in condenser E6 and flask B2, they are evacuated via pipe 15, with a condensed distillate fraction being sent via pump P4 and pipe 16 to the top of column C2 as reflux.

The liquid, which consists of solvent and extracted heavy compounds, is gradually reheated as it drops in the column; it is reboiled at about 180° C. in reboiler E7 and is sent back via a circulation pump P5 to be introduced via pipe 17 at the top of column C3 to regenerate the solvent, operating at a pressure that is close to atmospheric pressure.

After it is reboiled in exchanger E8, the regenerated solvent is obtained at about 230° C. at the bottom of column C3 and comes out via pipe 18. Sent back via pump P6, it is brought by cooling in exchanger E10 to a temperature close to the temperature of the tray on which it is introduced into column C2 via pipe 13.

The purified benzene comes out at the top of column C3 via pipe 19. After it is fully condensed in condenser E9 and flask B3, it is collected via pipe 20 at the desired purity. A fraction of the condensed distillate is returned to the top of column C3, via pump P7 and pipe 21, as reflux.

The following examples illustrate the invention. The post-treatment of the effluent from a reforming unit is described, at first without using the permeation stage (Example 1, comparative) and then with implementation of such a stage, in this case, a pervaporation stage (Example 2 according to the invention). In Example 3, treatment of the permeate by extractive distillation is described.

EXAMPLE 1 (comparative)

The treated batch is a reforming effluent that has the following composition:

5.2% by weight of benzene 17.8% by weight of toluene 23.5% by weight of xylenes and ethyl benzene.

A post-fractionating column that comprises 58 theoretical stages, at the level of the 36th stage, computed from the condenser, is fed with this batch at a flow rate of 170 t/h.

A vapor distillate that is totally condensed at 58° C. and that partially refeeds the column, with the liquid reflux rate relative to the feed being 0.7 by mass, is recovered at the top of the column. The distillate that is drawn off at the top contains 2.5% by weight of benzene or 10.6% by weight of the benzene fed.

Under these conditions, with no permeation unit, the bottom of the column, i.e., virtually 80% by weight of the feed flow, has a benzene concentration of 5.9% by weight.

EXAMPLE 2

The procedure of Example 1 above is reproduced by adding a pervaporation unit to it.

For this purpose, in theoretical stage No. 20, 27% by weight of the liquid phase that feeds the column is drawn off. The concentration of benzene of the liquid phase in this stage reaches 22% by mass, which corresponds approximately to the maximum concentration of benzene in the column.

This draw-off, at 107° C., is sent to a pervaporation unit that comprises a membrane of 3200 $m^2$ whose benzene selectivity relative to aliphatic hydrocarbons is about 10. This membrane was synthesized from a mixture of polyimide and polysuccinate according to the description of Example 7 of U.S. Pat. No. 4,944,880.

A proportion of 50% by mass of benzene that is contained in the draw-off is evacuated by pervaporation in the permeate, whose benzene concentration is set at 75% by mass.

The retentate, which contains no more than 12.6% by weight of benzene, is separated into two fractions, with one feeding the column at stage No. 21 and the other feeding the column at stage No. 50. In this way, it is possible, while keeping a low content of benzene in the distillate (2.5% by mass), to obtain a residue that does not contain more than 2.4% by weight of benzene.

EXAMPLE 3

The procedure of Example 2 above is reproduced by adding an extractive distillation unit to it.

For this purpose, the permeate that is obtained downstream from the pervaporation unit, after its vaporization in exchanger E5, is introduced in theoretical stage No. 20 of an absorption column C2 that comprises 30 theoretical stages and fed in tray No. 6 by a solvent that makes it possible to extract selectively benzene and heavier components. The solvent that is used in this example is N-methylpyrrolidinone (NMP). The mass solvent rate relative to the feeding is 4. The solvent is recovered at the bottom of the column after reboiling to 180° C., then it is pumped and sent to theoretical stage No. 5 of column C3 that comprises 17 theoretical stages, where it is regenerated. At the top of the column, after condensation at 86° C., the benzene with 99.96% by mass of purity is obtained. The solvent is reboiled at 230° C. at the bottom of column C3, then cooled to 80° C. and recycled to absorption column C2.

The preceding examples can be repeated with similar success by substituting the generically or specifically described reactants and/or operating conditions of this invention for those used in the preceding examples.

The entire disclosure of all applications, patents and publications, cited above and below, and of corresponding French application No. 96/11696, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for reducing the benzene content of a gasoline mixture that contains benzene and other hydrocarbons, comprising the following stages:

a) feeding said mixture to a distillation column feedpoint to separate an overhead distillate and a bottom residue;

b) withdrawing from the distillation column a sidestream having a benzene content richer than the distillate and the residue; and c) passing said sidestream to at least one permeation zone comprising a membrane selective for the permeation of benzene, to separate a retentate low in benzene, and a benzene-enriched permeate, dividing at least part of the retentate into two streams and recycling the divided streams to two different levels in the distillation column.

2. A process according to claim 1, wherein the hydrocarbon mixture that is to be treated contains 1 to 10% by mass of benzene.

3. A process according to claim 1, wherein said distillation column is a naphtha pre-fractionating column and said residue, low in benzene, is subjected to reforming in a catalytic reforming unit.

4. A process according to claim 1, wherein the feed to said distillation column is an effluent from a catalytic reforming unit.

5. A process according to claim 1, wherein said distillation column is a stabilization column.

6. A process according to claim 1, wherein in stage (a), the distillation column is operated at a pressure of 1 to 5 bar and heated to a bottom temperature of 150 to 200° C., with the top temperature being set at about 50° C. with a reflux ratio set at a value of 0.5 to 1 by mass relative to the feed of said column.

7. A process according to claim 1, wherein in stage (b), the sidestream is withdrawn at a level of the column where the benzene concentration is essentially at a maximum.

8. A process according to claim 1, wherein stage (b), the sidestream is brought to a temperature of 60 to 120° C. and to a sufficient pressure such that the sidestream is at least partially liquid.

9. A process according to claim 1, wherein in stage (b) the sidestream represents 20 to 50% by weight of the feed of the column.

10. A process according to claim 1, wherein in stage (b) the sidestream comprises a liquid phase and wherein the permeation stage of stage (c) is a pervaporation.

11. A process according to claim 1, wherein in stage (b) the sidestream comprises a vapor phase or a mixed phase and wherein the permeation stage of stage (c) is a vapor permeation.

12. A process according to claim 1, wherein in stage (c), the permeation device comprises a membrane selective for permeating benzene therethrough relative to the other components by at least 6:1.

13. A process according to claim 1, wherein the membrane used in permeation stage (c) comprises a chlorinated polyurethane, a polyimide/polyadipate, a polyimide/polysuccinate, a crosslinked copolymer of a polymer diol and a dianhydride, or a crosslinked polycarbonate.

14. A process according to claim 1, further comprising subjecting the permeate obtained at the end of stage (c) to extractive distillation.

15. A process according to claim 1, wherein said other hydrocarbons have 5 to 10 carbon atoms.

16. A process according to claim 2, wherein said other hydrocarbons have 5 to 10 carbon atoms.

17. A process according to claim 16, wherein in stage (b) the sidestream represents 20 to 50% by weight of the feed of the column.

18. A process according to claim 11, wherein one part of the retentate is introduced above the distillation column feedpoint and a second part of the retentate is introduced below the distillation column feedpoint.

19. A process according to claim 18, wherein in stage (b), the sidestream is withdrawn at a level of the column where the benzene concentration is essentially at a maximum.

* * * * *